United States Patent [19]

Buzzard

[11] 3,937,427

[45] Feb. 10, 1976

[54] CAB SIGNAL CONTROL CIRCUITS FOR RAILROAD INTERLOCKINGS

[75] Inventor: Kenneth J. Buzzard, Murrysville, Pa.

[73] Assignee: Westinghouse Air Brake Company, Swissvale, Pa.

[22] Filed: Jan. 24, 1975

[21] Appl. No.: 543,696

[52] U.S. Cl. ..... 246/34 CT; 246/34 R

[51] Int. Cl.[2] ..... B61L 21/06

[58] Field of Search ..... 246/34 CT, 34 R, 40, 113, 246/114 R, 114 A, 219

[56] References Cited

UNITED STATES PATENTS

| | | | |
|---|---|---|---|
| 2,454,249 | 11/1948 | Broadbent | 246/114 R |
| 2,478,601 | 8/1949 | Spray | 246/219 |
| 2,736,795 | 2/1956 | Witmer | 246/34 R |
| 3,524,054 | 8/1970 | Smith | 246/114 R |
| 3,526,378 | 9/1970 | Thorne-Booth | 246/34 CT |

*Primary Examiner*—Trygve M. Blix
*Assistant Examiner*—Reinhard J. Eisenzopf
*Attorney, Agent, or Firm*—A. G. Williamson, Jr.; R. W. McIntire, Jr.

[57] ABSTRACT

In a railroad interlocking, a cab signal transmitter is coupled to the rails at each exit location and at such other locations as are necessary to supply continuous cab signal energy to trains traversing any possible route through the interlocking. Where train shunts prevent the reception of cab signal energy, wire loops laid adjacent the rails carry the cab signal energy for train pickup. Each rail coupled transmitter is finally activated to supply energy when a train occupies an associated track section. However, the control circuit network for each transmitter also checks, as pertinent for the established route, that a route has been established and the approaching train authorized to traverse that route, that any succeeding track sections along the route are unoccupied, that the transmitter for a preceding section has been activated, and that transmitters for opposing or conflicting routes are not active. A loop transmitter is activated if the corresponding track stretch is included in the established route, the preceding transmitter is active, and the succeeding section is unoccupied. Thus, a train which overruns an entry signal receives no cab signal energy since neither a route nor train authority has been established. For similar reasons, a train which inadvertently enters a conflicting route receives no cab signal energy intended for the authorized train. Finally, if an insulated joint at the interlocking limits fails, a train waiting outside these limits cannot receive cab signal energy intended for a train traversing an established route.

10 Claims, 1 Drawing Figure

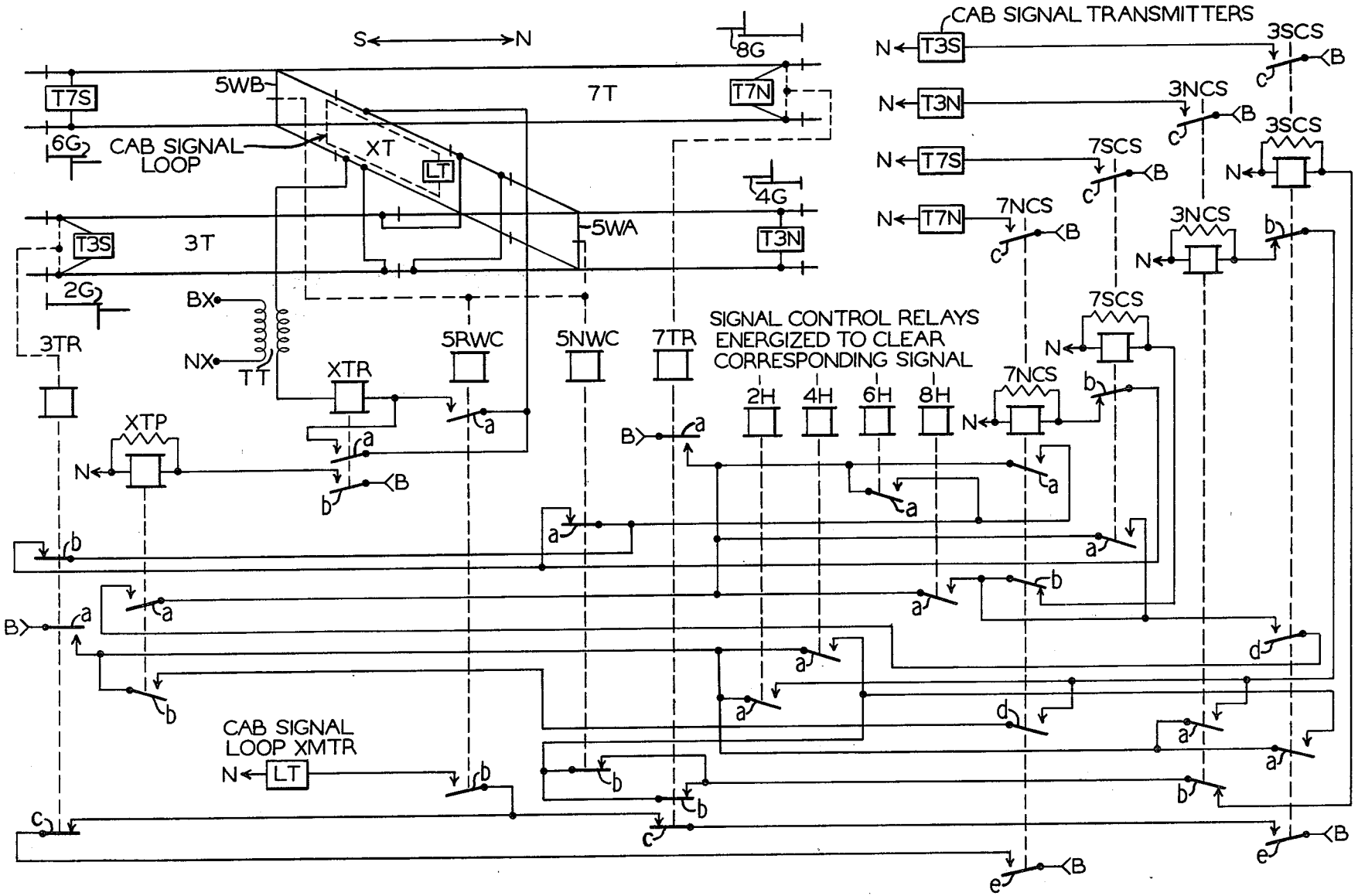
CAB SIGNAL TRANSMITTERS
3SCS
3NCS
7SCS
7NCS
T3S
T3N
T7S
T7N
SIGNAL CONTROL RELAYS ENERGIZED TO CLEAR CORRESPONDING SIGNAL
2H
4H
6H
8H
7TR
5NWC
5RWC
XTR
XTP
3TR
CAB SIGNAL LOOP XMTR
LT
CAB SIGNAL LOOP
5WA
5WB
7T
3T
XT
TT
BX
NX
2G
4G
6G
8G
N
S
B

CAB SIGNAL CONTROL CIRCUITS FOR RAILROAD INTERLOCKINGS

BACKGROUND OF THE INVENTION

My invention pertains to cab signal control circuits for railroad interlockings. More specifically, this invention relates to control circuits for controlling the fail-safe application of cab signal energy to the several track sections within a railroad interlocking.

One goal of cab signal control systems for trains is to maintain a continuous signal or control condition, of whatever type is appropriate, on board the train as it passes through crossovers and other types of railroad interlockings. It is frequently difficult to provide cab signal energy in the rails fed toward an oncoming train in crossover layouts as the train wheel and axle units tend to shunt out the cab signal energy because of the complex track circuit connections necessary in order to maintain continuous train detection. In other words, because of the necessity of continuously detecting the train passing through the interlocking, dead spots are sometimes created in the cab signal energy supply. Otherwise, if circuit compromises are made, dead spots in the continuous detection of single cars within the interlocking may occur. An associated problem is the prevention of the failure of an insulated joint marking the limits of the interlocking from leaking improper cab signal energy to a train waiting outside the interlocking limits. A corresponding problem is to prevent supplying, to a train which may have inadvertently overrun an interlocking home signal, the cab signal energy intended for another train being routed through the interlocking or crossover location. Obviously, either one of these conditions can create an unsafe operating situation in the movement of the trains. Thus, special attention is paid to preventing such reception of improper cab signal energy by a train under these fault conditions.

Accordingly, an object of my invention is an improved cab signal control circuit arrangement for railroad interlockings.

Another object of the invention is cab signal circuits for railroad interlockings in which energy is transmitted to the train to control the signals only when a train occupies the associated track section within the interlocking.

Also an object of the invention is cab signal control circuits for railroad interlockings which prevent the supply of cab signal energy to a train halted outside the interlocking limits under any track circuit fault condition.

Still another object of my invention is a cab signal control circuit arrangement for a railroad interlocking which inhibits the transmission of cab signal energy through a faulty insulated joint at the interlocking limits by withholding the application of such energy until an authorized train occupies the corresponding track section.

A further object of the invention is control circuits for a railroad interlocking system which apply cab signal energy only as a train occupies each track section along its authorized route.

Another object of the invention is a cab signal energy network which inhibits the supply of such energy to a train inadvertently occupying an unauthorized route in a railroad interlocking.

A still further object of the invention is a control circuit network for a railroad interlocking which prevents a train inadvertently occupying the interlocking from receiving cab signal energy transmitted to a train following an authorized route.

A still further object of my invention is a control circuit network for a railroad interlocking which supplies cab signal energy to preset sections along an established route only as a train authorized to traverse that route successively occupies such sections in proper sequence.

Other objects, features, and advantages of my invention will become apparent from the following specification when taken in connection with the accompanying drawing and the appended claims.

SUMMARY OF THE INVENTION

In practicing my invention, a cab signal transmitter is coupled to rails at each end of each track section. These transmitters are activated to supply cab signal energy through the rails only when the section is part of an established route and the authorized train occupies that section at its entrance end. Such an established route may, of course, include more than one track section so that more than one cab signal transmitter may be involved in supplying energy into the rails as the train moves along the route. The arrangement also provides, at selected locations, wire loops positioned adjacent to the rails to carry cab signal energy to assure that there is no dead section in the reception of such energy by the train moving along its route. In this specific illustration, a simple crossover interlocking between two main tracks is provided with only one wire loop used along a portion of the crossover track where cab signal energy in the rails is shunted out under various conditions by the wheel-axle units of the train and is thus not adequately received.

Each cab signal transmitter is controlled or activated by a corresponding normally deenergized cab signal relay. Each track section thus has two such relays associated therewith. Each cab signal control relay is energized normally by a circuit network which checks for train occupancy of the associated section, the establishment of a route, that the opposite direction cab signal relay has not been activated, and that a conflicting track section or route, where pertinent, is not occupied. Train occupancy of each section is detected by the release of the corresponding track circuit relay when the train is actually occupying the associated track section. The establishment of a route is determined by checking that the signal control relay is activated to clear the entry or home signal. If the transmitter is one supplying energy to a succeeding section along a route, the circuit for the associated actuating relay also checks that the immediately preceding approach section transmitter control relay has picked up. This completes the determination that the route was established and that the train is successively occupying the track sections along that route. In the specific illustration of a crossover, the preceding approach section may be the crossover track section for which a special detector track circuit is provided. The crossover is also provided with a wire loop adjacent to the rails for cab signal energy. The transmitter for the crossover section loop is energized by a circuit network which checks that a crossover route has been established and which is completed only when the initial cab signal control relay for that route picks up. Reviewing quickly, each cab signal transmitter control relay becomes energized, to activate its associated transmitter, by a circuit network which checks in some fashion that a route including that track section was established, that the train is occupying the corresponding section, has sequentially moved through the various sections along the route, and that no conflicting cab signal transmitter has been previously energized or activated.

DESCRIPTION OF THE ILLUSTRATED EMBODIMENT

I shall now describe in greater detail a specific embodiment of my invention illustrated in the accompanying drawing and then define the novel features thereof in the appended claims.

The single drawing FIGURE is a partly schematic, circuit diagram illustrating the cab signal control circuits embodying my invention as associated with a simple railroad interlocking layout.

In the illustrated circuit network, a source of direct current energy is supplied for the operation of the relays and to selectively activate the cab signal transmitters. A specific source is not shown since any one of several conventional types may be used with equal results. However, connections to the positive and negative terminals of this direct current source are designated by the references B and N, respectively, where they appear in the drawing. The terminals BX and NX shown in the upper left designate the opposite terminals of an alternating current source which is used, as will be more fully explained, to supply energy for a special track circuit.

In the upper left, in schematic form, a small railroad interlocking is illustrated which comprises a crossover between two main tracks. Each track and the crossover is illustrated by a conventional two-line representation to show the two rails. The outer limits of this interlocking are fixed by insulated joints which are illustrated in a conventional manner to form insulated track sections 3T and 7T in the lower and upper main track stretches, respectively. A wayside home or entry signal is located at each pair of insulated joints marking the outer limits of the interlocking for that track. These signals, illustrated by conventional symbols, are designated 2G and 4G for section 3T and 6G and 8G for section 7T. Each end of the crossover track is connected to the main track by a switch which is designated simply by the insulated rods shown between the points of the corresponding switch and referenced 5WA for the switch within section 3T and 5WB for the switch within section 7T. Trains normally move on the right-hand track for their direction of movement, that is, to the right (North) through section 3T and to the left (South) through section 7T, as controlled by signals 2G and 8G respectively. Reverse traffic moves are controlled through each section or for crossover moves by either signal 4G or signal 6G.

The switches of the crossover are assumed to be controlled from a single or centralized operating position and their condition is indicated by the switch correspondence relays 5NWC and 5RWC. These relays indicate not only the actual switch position, that is, normal or reverse, but also that the switch position corresponds with that selected by the interlocking operator. The control circuits for these switch correspondence relays are not specifically illustrated since several conventional arrangements may be used. However, to designate their association with the switches, dotted lines connect the designated switch rods with each of these correspondence relays. Specifically, relay 5NWC will be energized and picked up when each switch of the crossover is lined for normal movements along the main track and such positions are desired by the system operator. Under these conditions, relay 5RWC is released. Relay 5RWC will be energized and picked up when both switches of the crossover are positioned in their reverse position for train movement through the crossover in accordance with the operation or route selected by the interlocking operator. Under these conditions, relay 5NWC will be released. If the crossover switches are not both in the same position and/or if the position does not agree with that selected by the interlocking operator, both relays will be released. Conversely, both relays cannot be picked up simultaneously.

Track sections 3T and 7T are each provided with a track circuit for the detection of trains. Preferably, although not necessarily, these are conventional direct current track circuits. Since train detection in this manner is very conventional, only the track relay is shown connected to the rails by a dotted line, the remainder of such track circuits being well known. Track relays 3TR and 7TR are therefore coupled to the rails of sections 3T and 7T, respectively, and are normally picked up when no train is occupying any portion of the track sections. Conversely, when a portion of a train is within the outer limits of the interlocking in either section, the corresponding track relay 3TR or 7TR releases to indicate and register the occupancy. It is to be noted that various bond wire connections are made between the rails of section 3T and the rails of the crossover track to detect the occupancy of a portion of the crossover by a train as though it were actually occupying section 3T. These are conventional track circuit arrangements to extend the train detection to fouling points of the crossover rails. Similar connections, not illustrated, may be made to section 7T.

However, to assure that there will be no loss of detection of a train moving through the crossover and for cab signal controls, a special track section XT is formed by insulated joints within the crossover track. Track section XT is provided with a series track circuit which is supplied with energy by a track transformer TT, the primary of which is energized by the alternating current source designated by the terminals BX and NX. Track relay XTR of this track circuit is energized, because of the series nature of the track arrangement, only when a train occupies the crossover and the switches are correspondingly lined for such a reverse movement. In other words, the circuit for relay XTR can be traced from the lower terminal of the secondary winding of transformer TT through the winding of relay XTR and over front contact *a* of relay 5RWC, which is picked up when the switches are reversed by the operator, through the rail connection to the upper rail of section XT; thence through the wheel-axle shunts of the train occupying the section to the lower rail and by that rail connection to the upper terminal of the secondary of transformer TT. When relay XTR picks up, the closing of its front contact *a* completes a stick circuit arrangement which bypasses front contact *a* of relay 5RWC in the pickup circuit. It will be obvious, therefore, that the track circuit for section XT is effective to initially detect a train only when a route is lined through the crossover but that the detection of the train will continue if a car is inadvertently left in the crossover and switches are returned to their normal position, since its stick circuit will hold relay XTR energized. When relay XTR picks up, the closing of its front contact *b* completes a circuit between terminals B and N including the winding of a repeater relay XTP which thus follows directly the action of relay XTR. It will be noted, however, that a resistor shunt is connected across the winding of relay XTP to slightly delay its release when the relay winding is deenergized.

A separate cab signal transmitter is coupled to the rails at each end of sections 3T and 7T, which of course are the exit points for all routes through the illustrated interlocking. However, this type of connection of the cab signal transmitter only at the exit points is not necessarily true in a more complicated interlocking layout. These transmitters are shown by conventional blocks since they will be of a selected type from any of the various known arrangements to match the cab signal or speed control system in actual use. For convenience in showing control circuitry, equivalent blocks representing the same transmitters, and using the same reference characters, are shown to the right of the track diagram together with the specific control circuits. The control of these transmitters will be discussed subsequently. To prevent any loss in cab signal reception by a train moving through the interlocking due to its wheel and axle shunts, particularly in the crossover rails, a wire loop is laid adjacent and parallel to the rails in the crossover, corresponding substantially to the length of section XT. This wire loop is illustrated by a dotted line and shown as being inside the rails but this positioning is a matter of choice. Cab signal energy is supplied to the cab signal loop by a transmitter LT similar to those previously discussed. This transmitter, shown by a conventional block, is also again illustrated in the lower left with its specific control circuits.

Another set of relays not previously discussed are the signal control relays H, each numerical prefix corresponding to the wayside signal which that relay directly controls. No control circuits are shown for these signal relays but an explanatory note in the drawing designates the conditions under which each is energized. Such operation and the control circuits therefor are well known and understood in the art and the note is sufficient information for an understanding. Obviously, the pairs of relays 2H–4H and 6H–8H cannot simultaneously be picked up since opposing movements would then be authorized. With the crossover lined for a movement between the main tracks, only a single one of the H relays can be picked up since any other move would be in conflict with the crossover move. Although not specifically designated in the drawing, each signal control relay H is provided with a small amount of slow release time in order to allow the completion of other circuit actions when these relays are deenergized and release.

Each rail cab signal transmitter is controlled by an individual one of the cab signal actuating relays CS. For example, transmitter T3N at the right end of section 3T is activated when front contact *c* of relay 3NCS closes. Likewise, transmitter T7S at the left end of section 7T is energized and transmits cab signal energy into the rails when front contact *c* of relay 7SCS closes. In discussing the control circuits for the relays CS, it may be noted that there is one such relay for each exit location from this simple interlocking arrangement shown but a more complicated interlocking may include other CS relays.

Considering first relay 7NCS, an energizing circuit may be traced from terminal B over back contact *a* of relay 7TR, front contact *a* of relay 6H, front contact *b* of relay 3TR, back contact *b* of relay 7SCS, and the winding of relay 7NCS to terminal N. When relay 7NCS is energized, it closes its front contact *a* to bypass front contact *a* of relay 6H in the previously traced circuit to provide a stick circuit holding relay 7NCS energized after the train enters track section 7T. An alternate circuit uses front contact *a* of relay 5NWC in multiple with front contact *b* of relay 3TR to energize relay 7NCS. This latter path is effective when a main track move through section 7T has been established and a parallel move is occurring through track section 3T at the same time, which is permissible in the interlocking layout. In the circuit for relay 7NCS, the front contact of relay 6H checks that a route has been established through the interlocking and the entering or home signal for that route cleared. In other words, for a train to exit at the right end of section 7T, signal 6G at the left end of the track section must be clear. Back contact *b* of relay 7SCS assures that the opposing direction cab signal transmitter is not energized. Front contact *a* of relay 5NWC, closed when switch 5WB is in its normal position, checks that no interference with a train moving in the other main track can occur so that front contact *b* of relay 3TR may be open. Otherwise, occupancy of section 3TR is checked and entered into the circuit for relay 7NCS. It is to be noted, of course, that the circuit for relay 7NCS is not completed until the train occupies section 7T, causing the release of the corresponding track relay 7TR to close its back contact *a*. When the train thus accepts signal 6G and occupies section 7T, relay 6H will release. However, the slow release characteristic of this relay allows sufficient time for front contact *a* of relay 7NCS to close so that the stick circuit is completed to maintain the relay energized before the signal control relay releases.

The circuit network for relay 7SCS which controls cab signal energy for movement in the other direction through section 7T is of somewhat different form. The principal path begins again at back contact *a* of relay 7TR and thence includes front contact *a* of relay 8H, to check that a route has been established from right to left through section 7T and the signal 8G cleared, and back contact *b* of relay 7NCS to assure that cab signal energy for an opposite direction move is not being supplied through the track section. When relay 7SCS picks up, it closes its own front contact *a* which bypasses front contact *a* of relay 8H so that relay 7SCS will remain energized when the train enters the track section. When a move is to be made from signal 4G through section 3T and the crossover to exit from section 7T, relay 7SCS is energized over an alternate circuit path which includes back contact *a* of relay 7TR, front contact *a* of relay XTP which closes when the train occupies the crossover, and front contact *d* of relay 3SCS which is previously closed as the train initially enters the route, and thence over back contact *b* of relay 7NCS to the winding of relay 7SCS. Once again, when front contact *a* of relay 7SCS closes, it bypasses the series circuit through front contact *a* of relay XTP and front contact *d* of relay 3SCS. It is to be noted that the winding of each CS relay is shunted by a resistor to slightly retard the release of the relay contacts when the winding is deenergized. In the last traced circuit, this feature holds front contact *d* of relay 3SCS closed for a sufficient period until back contact *a* of relay 7TR closes, the necessity of which will appear shortly.

The circuit network for relay 3SCS compares with that just traced for relay 7NCS while the circuit paths for relay 3NCS compare with those for relay 7SCS. For example, the principal circuit for relay 3SCS includes front contact *a* of relay 4H and front contact *b* of relay 7TR with an alternate circuit over front contact *b* of relay 5NWC bypassing the contact of relay 7TR. This circuit network further includes back contact *b* of relay 3NCS and is completed by back contact *a* of relay 3TR when a train enters track section 3T at signal 4G. Front contact *a* of relay 3SCS provides a stick circuit which bypasses front contact *a* of relay 4H. In the network for relay 3NCS, the principal circuit path includes back contact *a* of relay 3TR, which provides a final closure of the network, front contact *a* of relay 2H, and back contact *b* of relay 3SCS. Front contact *a* of relay 3NCS then provides a stick circuit path bypassing front contact *a* of relay 2H. The alternate circuit for relay 3NCS, when a crossover move originating at signal 6G is to be made, includes back contact *a* of relay 3TR, front contact *b* of relay XTP, front contact *d* of relay 7NCS, and thence back contact *b* of relay 3SCS. Under these circumstances, front contact *a* of relay 3NCS bypasses the series circuit through front contact *b* of relay XTP and front contact *d* of relay 7NCS to provide the stick or holding energy path. In this last traced crossover circuit, front contact *d* of relay 7NCS checks that the train has previously entered the interlocking and that cab signal energy was provided while it moves through the portion of section 7T. Front contact *b* of relay XTP checks that the train has entered the crossover, i.e., that it is proceeding in succession through the sequential sections of the established route.

It was previously noted that front contact *c* of each CS relay closes to energize or activate the corresponding cab signal transmitter. For example, when front contact *c* of relay 7NCS closes, it energizes transmitter T7N which then supplies cab signal energy into the rails of section 7T. However, such cab signal energy is supplied only when a train passes the interlocking limits and moves into section 7T in its route through the interlocking. The loop cab signal transmitter LT is energized over one of two circuit paths. A first includes front contact *e* of relay 3SCS, front contact *c* of relay 7TR, and front contact *b* of relay 5RWC. Obviously, this last contact checks that the crossover is lined for a movement between the two main tracks while the other contacts check first that cab signal energy has already been supplied when the train entered section 3T and that section 7T is unoccupied. The second circuit also includes front contact *b* of relay 5RWC for the same purpose and, in addition, front contact *c* of relay 3TR to assure that section 3T is not occupied and front contact *e* of relay 7NCS which checks that cab signal energy was properly applied when the train entered section 7T en route to the crossover. It will be noted that the cab signal loop is thus supplied with energy as soon as the train enters either one of the main track sections headed for the crossover route and the energy is removed as soon as that train has passed over the crossover into the other main track section.

I shall now describe briefly the operation of this control circuit arrangement, first assuming that a northbound train is to move through section 3T, i.e., from left to right. To establish this movement, the interlocking operator assures that the crossover switches are in their normal position and then clears signal 2G to authorize the train movement. Since this train will exit the interlocking at the location of transmitter T3N, it is this transmitter which must be energized to supply energy for cab signal train control. The circuit for relay 3NCS is prepared by the closing of front contact *a* of relay 2H when the operator clears signal 2G. The circuit further checks at back contact *b* of relay 3SCS that the opposite direction cab signal energy is not being supplied. When this train accepts signal 2G and passes it to enter section 3T, relay 3TR releases to complete the circuit for relay 3NCS which then picks up to activate transmitter T3N to supply cab signal energy. The stick circuit for relay 3NCS is completed prior to the release of relay 2H so that the supply of cab signal energy is maintained as the train moves through the section. When the train completely clears section 3T so that relay 3TR again picks up, transmitter T3N is turned off by the release of relay 3NCS. Obviously, an equivalent operation occurs for a supply of cab signal energy by transmitter T7S when a train is authorized to move from right to left (southbound) through section 7T. Under this movement, relay 7SCS picks up when the train occupies section 7T and activates the corresponding transmitter. It may be further noted that if a train should inadvertently run by either signal 2G or 8G when they have not been cleared for a train movement, no cab signal energy can be supplied since the circuit for the corresponding CS relay was not prepared at front contact *a* of relay 2H or relay 8H, respectively, prior to the train passing the uncleared (stop) signal.

I shall now assume that a northbound train is to move through the interlocking over the crossover, entering at signal 6G and exiting the interlocking at the location of signal 4G. The operator establishes the route by reversing the crossover switches to line the crossover for movement between the main tracks and clears signal 6G to authorize the train movement. It is to be noted that, during this movement, cab signal energy will have to be supplied by different transmitters over different portions of the established route. Initially, transmitter T7N will supply energy followed by transmitter LT providing energy into the crossover cab signal loop. Finally, as the train moves through the final portion of the route, transmitter T3N must be activated to supply energy for that portion of the route within section 3T. Initially, a circuit is prepared for energizing relay 7NCS by the closing of front contact *a* of relay 6H, providing that front contact *b* of relay 3TR is closed to check that section 3T is completely unoccupied by any train. This is necessary since front contact *a* of relay 5NWC is open with the crossover lined for a reverse movement. It will be noted that, if this were a straight through movement on section 7T, the closed front contact *a* of relay 5NWC would eliminate the necessity for checking that section 3T was unoccupied by a train.

When this train accepts signal 6G and occupies section 7T, the release of relay 7TR to close its back contact *a* completes the circuit for relay 7NCS which picks up and closes its front contact *c* to activate transmitter T7N. Relay 7NCS also closes its front contact *a* to complete a stick circuit to hold the relay energized after relay 6H releases. Further, the closing of front contact *e* of relay 7NCS completes the circuit for energizing loop transmitter LT since front contacts *c* of relay 3TR and *b* of relay 5RWC are also closed. Thus, as soon as the train enters section 7T, the cab signal loop within the crossover rails is also supplied with cab signal energy. When the train enters the crossover and occupies section XT, relay XTR picks up, since front contact *a* of relay 5RWC is already closed, and completes a stick circuit which will hold relay XTR energized as long as any portion of the train continuously occupies section XT. Relay XTP is also energized by this action and picks up to close its front contact *b*. This prepares the circuit for energizing relay 3NCS over the circuit path further including front contact *d* of relay 7NCS. The closed condition of front contact *d* of relay 7NCS assures that cab signal energy has already been supplied to this train and that it is thus following a proper and authorized route through the interlocking while front contact *b* of relay XTP checks that the train has entered the actual crossover section.

As this train passes the insulated joint midway through the crossover so that it in effect occupies section 3T, relay 3TR releases. This completes the circuit for relay 3NCS by the closing of back contact *a* of relay 3TR. Relay 3NCS thus picks up, turns on transmitter 3TN, and completes its stick circuit to hold energized after relay 7NCS releases. This latter action occurs shortly, since the opening of front contact *b* of relay 3TR deenergizes relay 7NCS, but with sufficient delay to assure the pick up of relay 3NCS. Obviously, the release of relay 7NCS turns off transmitter T7N while the opening of front contact *c* of relay 3TR interrupts the circuit for energizing transmitter LT and the cab signal energy is removed also from the cab signal loop in the crossover. However, the stick circuit for relay 3NCS holds this relay energized and thus transmitter T3N turned on while the train continues to move to the exit point at signal 4G. Transmitter T3N remains energized until the train completely clears section 3T and relay 3TR picks up to open its back contact *a*. Obviously, an equivalent operation occurs if the train is moving from signal 4G through the crossover to exit at signal 6G. Under these conditions, transmitter T3S, loop transmitter LT, and transmitter T7S must be energized at the proper times to provide cab signal energy for the move.

If a train inadvertently enters the crossover route from the opposite end, that is, moving past signal 4G with the route lined for a move from signal 6G, no cab signal energy can be supplied since relay 3SCS cannot be energized with front contact *a* of relay 4H remaining open. If, after the crossover route from signal 6G is established but prior to the actual entry of the train into the interlocking, a second train inadvertently overruns signal 2G (not cleared), relay 3NCS cannot pick up since its circuit network is open at front contact *b* of relay XTP, since section XT is not occupied, while the parallel connection over front contact *a* of relay 2H remains open with the signal not cleared. Also, with relay 7NCS not yet energized, since the first train has not entered section 7T, the parallel circuit path is open at another point. For the same reason, a second train, waiting outside the interlocking at signal 2G for the first train crossing over to clear the interlocking, cannot inadvertently receive cab signal energy intended for the crossover train if an insulated joint at signal 2G fails. This is true since transmitter T3N is not activated until the first train enters section 3T, at which instant its wheel-axle units shunt such energy away from the distant end of section 3T at signal 2G. Therefore, under these conditions and similarly for other routes, a second train cannot steal the cab signal energy intended for a first train, whether or not the first train is present within the interlocking, in spite of an inadvertent overrun or an insulated joint failure. Thus, no unsafe cab signal indication can be created by an insulated joint failure or by inadvertent conflicting moves through the interlocking arrangement by simultaneously moving trains. It is also noted that, if a second train does inadvertently enter the route, the release of various track relays in response to this inadvertent occupation of a track circuit will interrupt the prepared circuits for the various CS relays so that no cab signal transmitter could be turned on even though the intended train simultaneously accepted its cleared signal.

Therefore, the circuits embodying my invention provide a fail-safe arrangement for supplying cab signal energy to an interlocking layout. The cab signal energy transmission prepared for an authorized train moving through the interlocking cannot be received by a second train which may inadvertently enter the interlocking over a conflicting route not established or which may be waiting immediately outside the interlocking limits when an insulated joint at that location has failed. Obviously, the illustrated network for the simple interlocking can be expanded to provide the same safety features for a more complicated layout in a well known and obvious manner. Thus, a simple, efficient, and economic arrangement is provided by which cab signal energy can be supplied to trains moving through railroad interlockings.

Although I have herein shown and described but a single cab signal control circuit arrangement for interlockings embodying my invention, it is to be understood that various changes and modifications may be made therein within the scope of the appended claims without departing from the spirit and scope of my invention.

Having now described the invention, what I claim as new and desire to secure by letters patent, is:

1. A cab signal control arrangement for railroad interlockings comprising in combination, a. an interlocking control system connected for establishing routes and authorizing train movements through said interlocking, b. occupancy detection means connected to rails at selected points for individually detecting the train occupancy of prefixed track sections within said interlocking, c. a plurality of cab signal transmitters coupled to the rails at selected locations within said interlocking and operable when activated for transmitting cab signal control energy through the rails of an associated track section, and d. a control circuit means coupled to each cab signal transmitter and controlled by said interlocking control control system, by said occupancy detection means, and by other cab signal transmitter control means for selectively activating the associated transmitter only when a train is authorized to traverse an established route, any remaining advance section of the route is unoccupied, any preceding transmitters along the route have been activated, and the train has occupied the corresponding section.

2. A cab signal control arrangement as defined in claim 1 which further includes, a. a cab signal wire loop positioned adjacent the rails of a preselected stretch of track within said interlocking, b. another cab signal transmitter connected for transmitting energy when activated through said loop, and c. a control circuit network coupled to said other transmitter and controlled by said interlocking control system, said track occupancy detector means, and the plurality of cab signal transmitter control means for activating said other transmitter only when said preselected track stretch is included in an established route, the preceding section cab signal transmitter has been activated, and the succeeding track section is unoccupied.

3. A cab signal control arrangement as defined in claim 2 in which, a. said interlocking comprises a crossover between two main tracks with one track section in each main track and one section in said crossover, b. said preselected track stretch is within said crossover track, c. said plurality of cab signal transmitters comprises one at each main track exit, d. said control circuit means for each transmitter comprises an actuating means and an energizing circuit therefor, each actuating means coupled for activating the corresponding transmitter when energized, e. the energizing circuit for the actuating means of the transmitter at a first exit end of one main track includes in series, 1. a contact closed when a train is authorized entry at the other exit of said one main track,
2. a contact closed when the associated track section is occupied,
3. a contact closed when the transmitter at the second exit end of said one track is not activated, and
4. contacts in parallel, one closed when the other main track section is unoccupied, the second closed when the established route includes only said one main track section, and f. the energizing circuit for the actuating means of the transmitter at the second exit end of said one main track includes in series, 1. said contact closed when the associated track section is occupied,
2. a contact closed when said transmitter at said first exit end is not activated, and
3. two parallel paths comprising a contact closed when a train is authorized entry at said first exit end in parallel with a contact closed when said crossover track is occupied in series with a contact closed when the transmitter at the second exit end of the second main track has been activated.

4. A cab signal control arrangement as defined in claim 3 in which, a. energizing circuits for the actuating means for the first and second exit end transmitters of said other main track section are equivalent to said energizing circuits for the actuating means of said second and first exit end transmitters, respectively, of said one main track section.

5. A cab signal control arrangement as defined in claim 4 in which said control circuit network for said other cab signal transmitter includes, a. a contact closed only when said crossover track is part of an established route and in series with b. a first circuit path comprising in series a contact closed when said other main track section is unoccupied and a contact closed when said actuating means for said first exit end transmitter of said one main track section is energized, and c. a second circuit path connected in parallel with said first circuit path and including in series a contact closed when said one main track section is unoccupied and a contact closed when said actuating means for the second exit end transmitter of said other main track section is energized.

6. In a railroad interlocking control system, through which interlocking move trains equipped with cab signal control apparatus, the combination comprising, a. a cab signal energy transmitter coupled to the rails at the exit end of each possible route through said interlocking for supplying cab signal control energy to a train traversing the route toward the exit end, b. each route including one or more train detector sections, c. other cab signal transmitters coupled to rails of selected stretches within the interlocking layout for also supplying cab signal energy to trains traversing established routes, d. an actuating means for each cab signal transmitter coupled to activate the associated transmitter when energized, e. a separate energizing circuit for each transmitter actuating means jointly controlled by said interlocking control system, said train detection sections, and other transmitter actuating means, for activating the associated transmitter only when a route is established including the associated exit or stretch of track, a train occupies the associated detection sections of that route in sequence, and other transmitters associated with conflicting routes are not activated.

7. A control system as defined in claim 6 in which, a. the established route includes a first detector section, a crossover section, and an exit section, each provided with means for detecting train occupancy of the section, b. the exit transmitter supplies cab signal energy only when a train is detected which previously occupied said first section, c. said first section receiving cab signal from an associated transmitter only when a train authorized to traverse the established route enters said first section, and which further includes, d. a wire loop positioned adjacent the rails of at least a portion of said crossover section to couple with the cab signal apparatus of trains traversing said route, e. another transmitter coupled to said loop for supplying cab signal energy to train apparatus when activated, f. an actuating circuit connected for activating said loop transmitter only when the transmitter associated with said first section has been activated and said exit section is unoccupied.

8. A control system as defined in claim 7 in which, a. the energizing circuit for the first section transmitter actuating means includes in series, 1. a contact closed when the established route entry signal authorizes a train movement through that route, 2. a contact closed when the opposite direction transmitter actuating means is not energized,
3. a contact closed when said exit section is unoccupied, and
4. a contact closed when the first section becomes occupied, b. the energizing circuit for the exit section transmitter actuating means includes in series,
1. a contact closed when said first section actuating means is energized,
2. a contact closed when a train is detected occupying said crossover section,
3. a contact closed when the train occupies said exit section, and
4. a contact closed when the opposite direction exit section transmitter actuating means is not energized, and c. said actuating circuit for said loop transmitter includes,
1. a contact closed when the route through said crossover section is established,
2. another contact closed when said first section actuating means has been energized, and
3. a contact closed when the exit section is unoccupied.

9. A cab signal control arrangement, for use with a railroad interlocking control system operable for establishing selected routes including one or more detector track sections through a railroad interlocking, comprising in combination, a. a cab signal energy transmitter coupled to the rails at each exit point of said interlocking for supplying cab signal energy through said rails when activated at selected times, b. a multi-circuit control network for each transmitter coupled for selectively activating the associated transmitter and including,
1. at least one contact closed when an interlocking route is established with its exit at the associated transmitter rail couplings,
2. a contact closed when the opposite direction transmitter is not activated,
3. a contact closed when the track section including the associated exit end is occupied by a train, and
4. one or more contacts responsive to train detection in other track sections included in the established route, c. a circuit path coupled for activating the associated transmitter being completed only when a train authorized to traverse the established route and having occupied any preceding sections occupies the section including the associated exit end.

10. A cab signal control arrangement as defined in claim 9 which further includes, a. a cab signal loop positioned adjacent a preselected stretch of rails within said interlocking, b. another cab signal transmitter connected for transmitting energy when activated through said loop to trains, c. another multi-circuit network connected for selectively activating said other transmitter and including,
1. a contact closed only when said stretch is part of an established route,
2. contacts responsive to the occupancy condition of succeeding track sections in either direction along an established route including said stretch,
3. contacts responsive to the activation of preceding transmitters along said established routes including said stretch, d. a selected activating circuit path through said other network being completed to activate said other transmitter when a preceding transmitter is activated to supply cab signal energy for a train authorized to traverse a route including said stretch and the succeeding section is unoccupied by a train.

* * * * *